US005697842A

United States Patent [19]

Donnelly

[11] Patent Number: 5,697,842

[45] Date of Patent: Dec. 16, 1997

[54] RIDGE VENT APPARATUS FOR ATTIC VENTING

[76] Inventor: Michael P. Donnelly, 316 Walnut St., Hollywood, Fla. 33019

[21] Appl. No.: 720,561

[22] Filed: Sep. 30, 1996

[51] Int. Cl.[6] ..... F24F 7/02

[52] U.S. Cl. ..... 454/365; 52/199

[58] Field of Search ..... 454/365; 52/198, 52/199

[56] References Cited

U.S. PATENT DOCUMENTS

| | | | |
|---|---|---|---|
| 2,579,662 | 12/1951 | Gibson . | |
| 2,625,094 | 1/1953 | Bonforte . | |
| 3,073,235 | 1/1963 | Smith et al. | 454/365 X |
| 3,625,134 | 12/1971 | Smith . | |
| 4,080,083 | 3/1978 | Malott | 403/305 |
| 4,201,121 | 5/1980 | Brandenburg, Jr. . | |
| 4,545,291 | 10/1985 | Kutsch et al. . | |
| 4,545,292 | 10/1985 | Inokawa et al. | 454/365 |
| 4,558,637 | 12/1985 | Mason | 454/365 |
| 4,685,265 | 8/1987 | Cooper | 454/365 X |
| 5,326,318 | 7/1994 | Rotter | 454/365 |
| 5,339,582 | 8/1994 | Sells | 454/365 X |

FOREIGN PATENT DOCUMENTS

| | | | |
|---|---|---|---|
| 961 291 | 3/1957 | Germany | 52/199 |

*Primary Examiner*—Harold Joyce
*Attorney, Agent, or Firm*—Oltman, Flynn & Kubler

[57] ABSTRACT

A vent apparatus for peaks of sloped roofs formed of roofing sheets include a number of roof tiles, a longitudinal vent gap between the roofing sheets at the peak, two rail members, one rail member being secured to the roofing sheets longitudinally along each side of the vent gap, where the rail members are laterally spaced apart from each other a distance, each rail member including an upright side wall portion, a fastening flange portion angling downwardly and outwardly from the lower edge of the side wall portion to rest against the roofing sheets, a series of tile fastening blocks fitted between the rail members and spaced apart from each other a distance substantially matching the length of the individual the roof tiles, a series of the tiles placed in overlapping fashion and longitudinally along and straddling both of the rail members, each tile having a higher end which rests on top of the lower end of the next tile in the series of the tiles so that the overlapping tile segments are located over positionally corresponding fastening blocks, where the roof tiles are secured to the roofing sheets in conventional fashion and where the upper end of each row of tiles is adjacent to the side wall portion of one of the rail members, so that the rail members are substantially hidden behind the rows of tiles.

15 Claims, 2 Drawing Sheets

RIDGE VENT APPARATUS FOR ATTIC VENTING

BACKGROUND OF THE INVENTION

1. Field of the Invention

The present invention relates generally to the field of roof vent structures for venting attics of buildings. More specifically the present invention relates to a vent apparatus for securing to the peak of a sloped roof to be covered with roof tiles.

The conventional plywood roofing sheets fastened to the roof trusses are sized and positioned, for purposes of the present invention, to stop short of meeting at the roof peak, and thus to define a vent gap extending longitudinally along the peak. The gap width is sized to be narrower than the width of the roof tiles selected to cover the particular roof.

The vent apparatus includes two rail members, one rail member being secured to the roofing sheets longitudinally along each side of the gap. The rail members are laterally spaced apart from each other a distance substantially matching the width of the vent gap. Each rail member is shaped from elongate sheet stock to include an upright side wall portion, a fastening flange portion angling downwardly and outwardly from the lower edge of the side wall portion to rest against the roofing sheets, and a locking lip portion extending perpendicularly from the side wall portion upper edge toward the opposing rail member and doubled back over itself for increased thickness and strength. The fastening flange portions are angled as needed relative to the side wall portions to duplicate the pitch of the roof on either side of the peak and thus to make flat, face-to-face contact with the roofing sheets. A longitudinal series of wooden, tile fastening blocks are fitted snugly between the two rail members and spaced apart from each other a distance substantially matching the length of the individual roof tiles. The height of each block is greater than the height of the rail member side wall portions and a locking lip portion notch is provided on either rail member abutting end of the block which is sized to snugly receive a rail member locking lip portion.

A series of the roof tiles, which are preferably barrel tiles, are placed longitudinally along and onto the rail members in conventional tile overlapping fashion. Each tile has a higher end which rests on top of the lower end of the next tile in the series, and the overlapping tile segments are positioned directly over each fastening block. A conventional weatherproof sealing glue such as RT-600 is spread between tiles in the segments where they overlap and contact each other. A tile fastener hole is provided in the lower end of each tile by the manufacturer, within the tile overlap segment, and a screw fastener is inserted through the tile fastener hole and into the fastening block below. An end cap is fitted and sealingly fastened onto each common end of the rail members to close the apparatus ends against water intrusion. Rows of tiles are then secured to the roofing sheets in conventional fashion and the upper end of each tile row abuts the side wall portion of one of the rail members, such that the vent apparatus is substantially hidden behind the tile rows on the completed roof. Air can enter and exit the resulting vent apparatus under the tile side portions spaced above and laterally overhanging the rail members and through the open ends of the series of tiles on top of the rail members, which are in open communication with the building interior through the vent gap.

2. Description of the Prior Art

There have long been venting structures for passing air into and out of building roofs and attics. These prior structures have tended to be complex, relatively expensive, conspicuous and visually unappealing.

Gibson, U.S. Pat. No. 2,579,662, issued on Dec. 25, 1951, discloses a ventilating device for mounting onto the peak of a sloped building roof. Gibson includes a generally rectangular body portion of sheet metal with integrally formed end walls, outwardly extending flanges at each body portion end, and screen members forming the body portion side walls. The body portion is split at the end walls and creased along the top wall over the peak line so that the body portion may be bent into an inverted V-shape along the top wall crease to make the flanges rest flat against the roof on either side of the peak. A problem with Gibson is that the body portion is wide and awkward. Another problem is that no provision is apparently made to conceal the ventilating device once it is installed.

Bonforte, U.S. Pat. No. 2,625,094, issued on Jan. 13, 1953, reveals a ventilating ridge roll for roofs. Bonforte includes a pair of spaced apart parallel base members positioned on either side of a longitudinal gap at the roof peak. These base members have divergent lower portions which are adapted to be secured by fastening elements to a roof structure. The base members also have outwardly angled flanges at their upper edges. A longitudinal series of upstanding supports are periodically provided between the base members along the roof peak. An elongated cap member rests on top of the upstanding supports, and has arcuate side portions which extend outwardly and downwardly to define air passing overhangs on either side of the base members. Air passes underneath these overhangs, between the base members and through the peak gap to vent the attic. A problem with Bonforte is that the ventilating device remains prominently visible and unsightly.

Rotter, U.S. Pat. No. 5,326,318, issued on Jul. 5, 1994, discloses a roof ridge ventilator for ventilating a building having a sloped roof with an open slot disposed longitudinally along its ridge. Rotter includes a ventilator structure designed to straddle the ridge slot and support the heavy roofing tiles above the roof surface. The ventilator structure includes a metal elongated support member adapted to straddle the slot so that its longitudinal axis is substantially aligned over the longitudinal axis of the slot. The support member is shaped essentially as a hollow rectangular-section beam with the bottom of the beam open and skirt sections flared therefrom at the slope angle of the roof, including an upright support member and a series of cap members overhanging and abutting adjacent tiles. A problem with Rotter is that lateral loading such as in high wind could cause the cap members to slide over the tiles and the upright support member to bend or break, opening the longitudinal vent and thus the building to water intrusion and damage. Another problem is that the cap member is apparently larger than and would not visually match the tiles.

Brandenburg, U.S. Pat. No. 4,201,121, issued on May 6, 1980, reveals a method of venting heat from homes. Heated air enters vent receptacles in the ceilings of the home and passes upwardly through a vertical vent into a branch vent extending along the sloped roofing sheets lower surfaces to a vent structure at the roof peak. The peak vent structure has laterally overhanging portions with openings underneath through which the heated air escapes into the atmosphere. Fans may be provided in the ceiling vent receptacles. A problem with Brandenburg is that the entire venting system together with the roof vent structure, and the installation into ceilings and throughout attics, make it prohibitively expensive. Another problem is that no provision apparently is made to conceal the peak vent structure.

Malott, U.S. Pat. No. 4,080,083, issued on Mar. 21, 1978, discloses connectors for a roof ridge ventilator. Connectors connect adjacent roof ridge ventilator sections. Once again, no provision is made to effectively conceal the unsightly peak vent structure. The same is true of Kutsch, et al., U.S. Pat. No. 4,545,291, issued on Oct. 8, 1985, which teaches a bulky, conspicuous sheet metal box ventilator with louvers mounted on the peak, and Inokawa, et al, U.S. Pat. No. 4,545,292, issued on Oct. 8, 1985. Inokawa, et al., teaches a cumbersome, high profile peak vent structure including an air duct provided above a rafter. At least one ventilator is provided in lieu of several ridge tiles which projects above the roof ridge and a series of lateral air passing ports, and includes two parallel and spaced apart vent wall portions extending above the roof peak, two shoulder portions extending laterally outward from the wall portions and upper and lower frame members. Inokawa, et al., is also costly and complex. Smith, U.S. Pat. No. 3,625,134, issued on Dec. 7, 1971 teaches a wide and complex roof ridge ventilator somewhat similar to that of Inodawa, et al.

It is thus an object of the present invention to provide a roof venting apparatus which passes air into and out of an attic or equivalent upper area of a building through the roof peak while preventing water entry from various weather conditions.

It is another object of the present invention to provide such an apparatus which passes air freely and with minimal flow resistance and uniformly along its entire length.

It is still another object of the present invention to provide such an apparatus which is sturdy and stable, and thus able to withstand high wind and impact loading resulting from severe weather conditions.

It is finally an object of the present invention to provide such an apparatus which is highly inconspicuous and relatively inexpensive to manufacture and install.

SUMMARY OF THE INVENTION

The present invention accomplishes the above-stated objectives, as well as others, as may be determined by a fair reading and interpretation of the entire specification.

A vent apparatus is provided for peaks of sloped roofs formed of roofing sheets, including a number of roof tiles, a longitudinal vent gap between the roofing sheets at the peak, two rail members, one rail member being secured to the roofing sheets longitudinally along each side of the vent gap, where the rail members are laterally spaced apart from each other a distance, each rail member including an upright side wall portion, a fastening flange portion angling downwardly and outwardly from the lower edge of the side wall portion to rest against the roofing sheets, a series of tile fastening blocks fitted between the rail members and spaced apart from each other a distance substantially matching the length of the individual the roof tiles, a series of the tiles placed in overlapping fashion and longitudinally along and straddling both of the rail members, each tile having a higher end which rests on top of the lower end of the next the tile in the series of the tiles so that the overlapping tile segments are located over positionally corresponding fastening blocks, where the roof tiles are secured to the roofing sheets in conventional fashion and where the upper end of each row of tiles is adjacent to the side wall portion of one of the rail members, so that the rail members are substantially hidden behind the rows of tiles.

The rail members are preferably laterally spaced apart from each other a distance substantially matching the width of the vent gap. The apparatus preferably additionally includes a locking lip portion extending laterally from the side wall portion upper edge toward the opposing rail member. Each locking lip portion is optionally doubled back over itself for increased thickness and strength. The roof tiles are preferably barrel tiles. The apparatus may additionally include a weather-proof sealing glue spread between overlapping portions of the roof tiles. Where each tile in the series includes a tile fastener hole located in the lower end of each tile within the tile overlap segment, the apparatus additionally includes a screw fastener inserted through the tile fastener hole and into one of the fastening blocks located below the fastener hole. The fastening flange portions are preferably bent relative to the side wall portions to duplicate the pitch of the roof on either side of the roof peak to make face-to-face abutment with the roofing sheets, and the flange fasteners pass through the fastening flange portions and into the roofing sheets to anchor the rail members to the roof.

Where the roof tile is barrel tile, the height of the side wall portions substantially matches the height of the roof tiles to maximize concealment of the rail members, and air enters and exits the vent apparatus under the side portions of the roof tiles in the series of tiles, which are spaced above and laterally overhang the rail members, and through open ends of the series of tiles above the rail members. Each fastening block preferably has a length substantially equivalent to the width of the vent gap to fit snugly between the rail members, and the height of each fastening block is preferably greater than the height of the rail member side wall portions to extend above the rail members, and a locking lip notch is preferably provided in either rail member abutting block end for snugly receiving one rail member locking lip portion. The fastening blocks are made of wood. Fastening block fasteners pass through the rail member side wall portions and into the fastening blocks to hold the fastening blocks in position and to strengthen the overall structure of the apparatus. The apparatus preferably additionally includes an end cap fitted and fastened onto each common end of the rail members to close the ends of the apparatus against water intrusion. Each end cap preferably includes a cap lip having cap lip segments contoured to fit snugly around the rail member side wall portions, around the rail member fastening flange portions and around the rail member locking lip portions, and includes a cap end wall interconnecting the cap lip segments. Each end cap is preferably fastened in place with cap fasteners passing through the rail member side wall portions and the cap lip.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
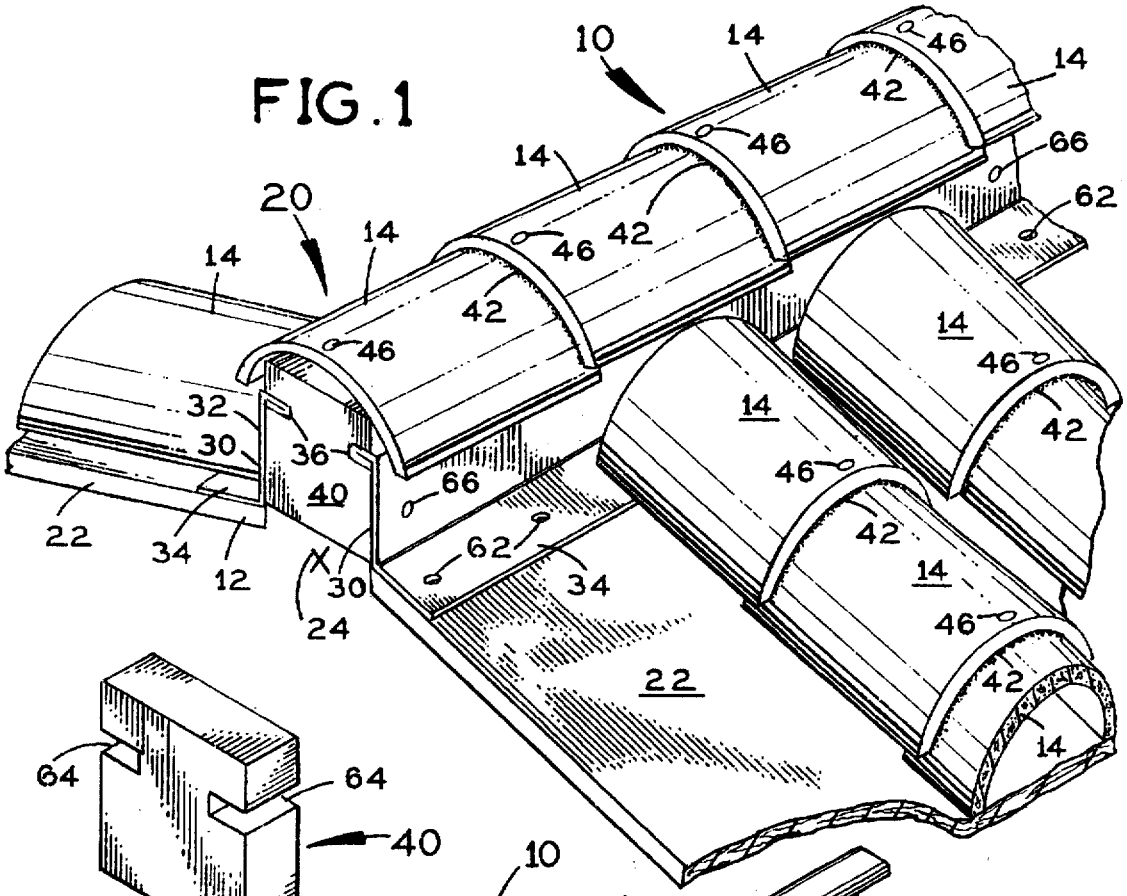
FIG. 1 is a perspective view an end of the ridge vent apparatus, with the end cut away to reveal a fastening block. The vent structure end is fitted with an end cap or alternatively is filled with cement or concrete to match the appearance of the rest of the roof.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 3:
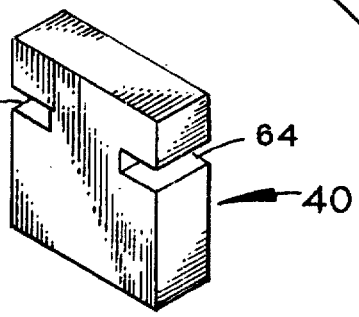
FIG. 3 is a perspective view of one of the fastening blocks, showing the locking lip receiving notches.
Figure 2:
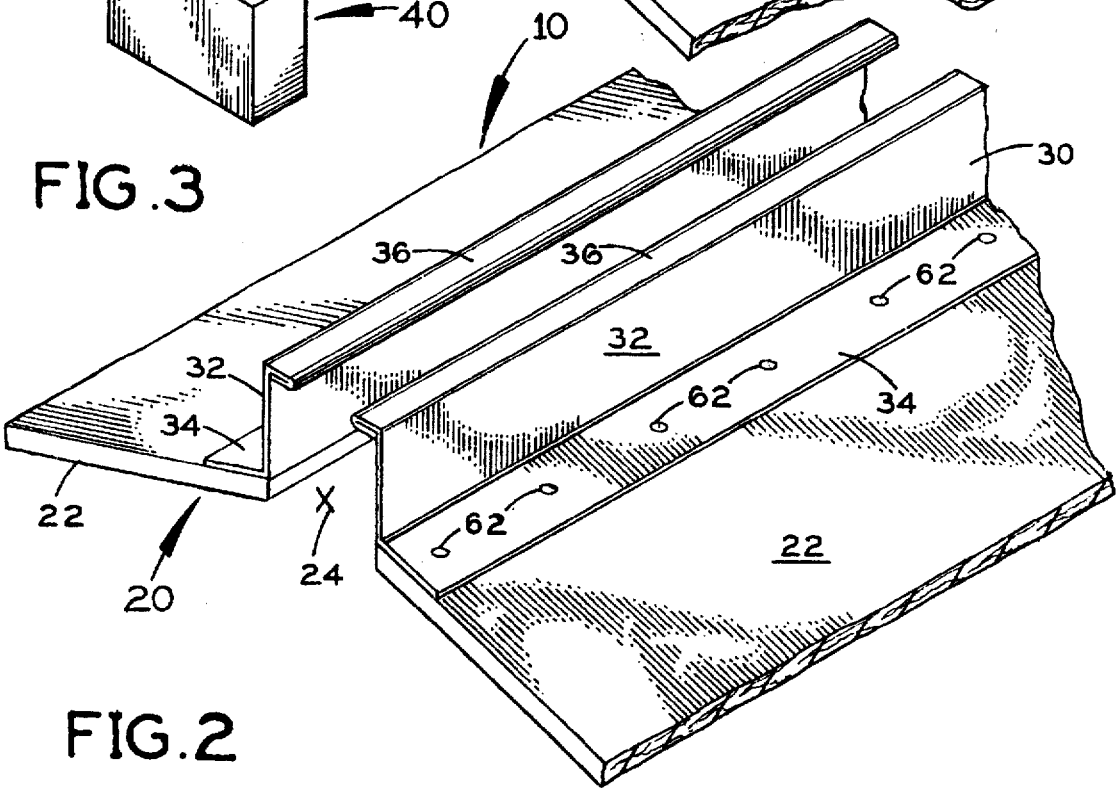
FIG. 2 is a perspective view of the two parallel rail members, showing the locking lip, side wall and fastening flange portions.
Figure 4:
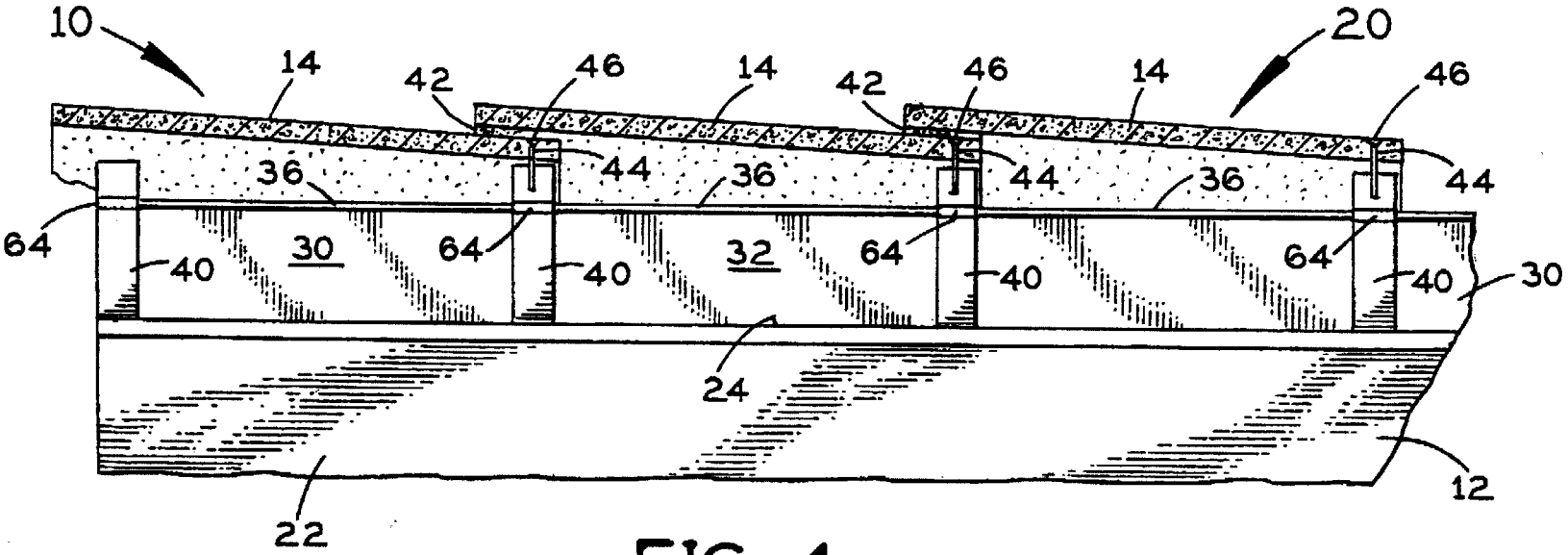
FIG. 4 is a cross-sectional side view of the apparatus showing the locational relationships between the tiles on top of the rail members and the fastening blocks.
Figure 5:
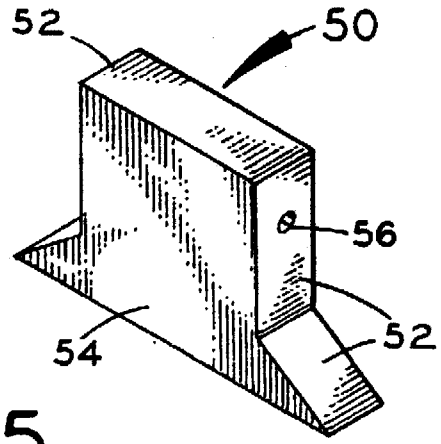
FIG. 5 is a perspective view of one of the end caps.

Referring to FIGS. 1–5, a vent apparatus 10 is disclosed for securing to the peak 12 of a sloped roof 20 to be covered with roof tile 14, such as barrel tile. The conventional plywood roofing sheets 22 fastened to the roof trusses are sized and positioned for purposes of the present invention to stop short of meeting at the roof peak 12, and thus to define a vent gap 24 extending longitudinally along the peak 12. The gap 24 width is sized to be narrower than the width of the tiles 14 selected to cover the particular roof 20.

Vent apparatus 10 includes two rail members 30, one rail member 30 being secured to the roofing sheets 22 longitudinally along and immediately adjacent to each side of gap 24. See FIG. 1. Rail members 30 are laterally spaced apart from each other a distance substantially matching the width of vent gap 24. Each rail member 30 is shaped from elongate sheet stock to include an upright side wall portion 32, a fastening flange portion 34 angling downwardly and outwardly from the lower edge of the side wall portion 32 to rest against the roofing sheets 22, and a locking lip portion 36 extending perpendicularly from the side wall portion 32 upper edge toward the opposing rail member 30 and doubled back over itself for increased thickness and strength. A series of wooden, tile fastening blocks 40 are fitted snugly between the two rail members 30, spaced apart from each other a distance substantially matching the length of the selected individual roof tiles 14.

A series of tiles 14 are placed longitudinally along and onto the rail members 30 in conventional tile overlapping fashion, to straddle both rail members 30. Each tile 14 has a higher end which rests on top of the lower end of the next tile 14 in the series, and the overlapping tile 14 segments are positioned directly over a corresponding fastening block 40. See FIG. 4. A conventional weather-proof sealing glue 42 such as RT-600 is spread between tiles 14 in the segments where they overlap and contact each other. A tile fastener hole 44 is provided in the lower end of each tile 14 by the manufacturer, within the tile 14 overlap segment, and a tile fastener 46 such as a screw is inserted through tile fastener hole 44 and into the fastening block 40 immediately below. An end cap 50 is fitted and sealingly fastened onto each common end of the rail members 30 to close the apparatus 10 ends against water intrusion. Rows of tiles 14 are then secured to the roofing sheets 22 in conventional fashion and the upper end of each tile 14 row abuts the side wall portion 32 of one of the rail members 30, such that vent apparatus 10 is substantially hidden behind the tile 14 rows on the completed roof 20.

Fastening flange portions 34 are bent to be angled as needed relative to side wall portions 32 to duplicate the pitch of the roof 20 on either side of the peak 12 and thus to make flat, face-to-face abutment with roofing sheets 22. Conventional roofing tacks or other ordinary fasteners 62 are driven through the fastening flange portions 34 into the roofing sheets 22, and preferably into the trusses beneath roofing sheets 22 as well, to anchor rail members 30 to roof 20. Where barrel tile 14 is used, the height of side wall portions 32 is selected to substantially match the height of the barrel tile 14, to assure maximum rail member 30 concealment.

Each fastening block 40 is preferably a two inch thick board segment having a length substantially equivalent to the gap 24 width to fit snugly between rail members 30. See FIG. 3. The height of each block 40 is preferably greater than the height of rail member side wall portions 32 and a locking lip portion notch 64 is provided on either rail member-abutting end of the block 40, which is sized to snugly receive a rail member locking lip portion 36. The notches 64, for purposes of discussion, may be said to divide blocks 40 into upper and lower block portions. The upper block portion extending above rail members 30 receives a tile fastener 46, which may pass down through the block 40 into the lower block portion. Block fasteners 66 preferably pass through the rail member side wall portions 32 and into blocks 40 to hold blocks 40 in position and to strengthen the overall vent apparatus 10 structure.

Each end cap 50 preferably includes a cap lip 52 contoured to fit snugly around the rail member side wall portions 32, around the fastening flange portions 34 and around the locking lip portions 36, and includes a cap end wall 54 interconnecting these cap lip 52 segments. See FIG. 5. Sealing glue 42 is spread within cap lip 52, and the end cap 50 is fitted over rail member 30 ends and fastened in place with ordinary sheet metal screws 56 passing through the rail members 30 and the cap lip 52. Rail members 30 and end caps 50 may be pressed or molded of galvanized steel, aluminum, copper or any other suitable material.

Air can enter and exit the resulting vent apparatus 10 under the tile 14 side portions spaced above and laterally overhanging the rail members 30 and through the open ends of the series of tiles 14 on top of rail members 30, which are all in open communication with vent gap 24 itself. Vent apparatus 10 may or may not extend the full length of the peak 12, depending upon the requirements of the specific roof 20 architecture.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A vent apparatus for peaks of sloped roofs formed of roofing sheets, comprising:

a plurality of roof tiles, a longitudinal vent gap between said roofing sheets at said peak, two rail members, said rail members being secured to the roofing sheets longitudinally along each side of said vent gap, wherein said rail members are laterally spaced apart from each other a distance, each said rail member including an upright side wall portion, a fastening flange portion angling downwardly and outwardly from the lower edge of said side wall portion to rest against the roofing sheets, a series of tile fastening blocks fitted between said rail members and spaced apart from each other a distance substantially matching the length of the individual said roof tiles, a first series of said tiles placed in overlapping fashion and longitudinally along and straddling both said rail members, each said tile having a higher end which rests on top of the lower end of the next said tile in said series of said tiles such that the overlapping tile segments are located over positionally corresponding said fastening blocks, wherein a second series of said tiles are secured to the roofing sheets in conventional fashion and wherein the upper end of each row of said second series of tiles is adjacent to the side wall portion of one of said rail members, such that said rail members are substantially hidden behind said rows of tiles.

2. An apparatus according to claim 1, wherein said rail members are laterally spaced apart from each other a distance substantially matching the width of said vent gap.

3. An apparatus according to claim 1, additionally comprising a locking lip portion extending laterally from said side wall portion upper edge toward the opposing said rail member.

4. An apparatus according to claim 3, wherein each said locking lip portion is doubled back over itself for increased thickness and strength.

5. An apparatus according to claim 1, wherein said roof tiles are barrel tiles.

6. An apparatus according to claim 1, additionally comprising a weather-proof sealing glue spread between overlapping portions of said roof tiles.

7. An apparatus according to claim 1, wherein each said tile in said first series comprises a tile fastener hole located in the lower end of each tile within said tile overlap segment, additionally comprising a screw fastener inserted through said tile fastener hole and into one said fastening block located below said fastener hole.

8. An apparatus according to claim 1, wherein said fastening flange portions are bent relative to said side wall portions to duplicate the pitch of the roof on either side of the roof peak to make face-to-face abutment with the roofing sheets, and wherein flange fasteners pass through said fastening flange portions and into the roofing sheets to anchor said rail members to the roof.

9. An apparatus according to claim 1, wherein said roof tile is barrel tile, and wherein the height of said side wall portions substantially matches the height of said roof tiles, to maximize concealment of said rail members, wherein air enters and exits said vent apparatus under the said side portions of said roof tiles in said first series of tiles, which are spaced above and laterally overhang said rail members.

10. An apparatus according to claim 3, wherein each said fastening block has a length substantially equivalent to the width of said vent gap to fit snugly between said rail members, and wherein the height of each said fastening block is greater than the height of said rail member side wall portions to extend above said rail members, and wherein a locking lip notch is provided in either rail member abutting block end for snugly receiving one said rail member locking lip portion.

11. An apparatus according to claim 10, wherein said fastening blocks are made of wood.

12. An apparatus according to claim 10, wherein fastening block fasteners pass through said rail member side wall portions and into said fastening blocks to hold said fastening blocks in position and to strengthen the overall structure of said apparatus.

13. An apparatus according to claim 1, additionally comprising an end cap fitted and fastened onto each common end of said rail members to close the ends of said apparatus against water intrusion.

14. An apparatus according to claim 13, wherein each said end cap comprises a cap lip having cap lip segments contoured to fit snugly around said rail member side wall portions, around said rail member fastening flange portions and around said rail member locking lip portions, and comprises a cap end wall interconnecting said cap lip segments.

15. An apparatus according to claim 14, wherein each said end cap is fastened in place with cap fasteners passing through said rail member side wall portions and said cap lip.

* * * * *